US007055479B2

(12) United States Patent
Sailer et al.

(10) Patent No.: US 7,055,479 B2
(45) Date of Patent: Jun. 6, 2006

(54) COUPLING MECHANISM

(75) Inventors: Peter Sailer, Erlangen (DE); Oliver Schnell, Veitsbronn (DE); Dieter Schmidt, Nuremburg (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 11/014,468

(22) Filed: Dec. 16, 2004

(65) Prior Publication Data

US 2005/0132993 A1 Jun. 23, 2005

Related U.S. Application Data

(60) Provisional application No. 60/586,143, filed on Jul. 7, 2004.

(30) Foreign Application Priority Data

Dec. 20, 2003 (DE) ..... 103 60 098

(51) Int. Cl.
*F01L 1/14* (2006.01)

(52) U.S. Cl. ..... 123/90.59; 123/90.52; 123/90.55

(58) Field of Classification Search ..... 123/90.16, 123/90.27, 90.31, 90.44, 90.45, 90.46, 90.48, 123/90.52, 90.55, 90.6, 90.59
See application file for complete search history.

(56) References Cited

U.S. PATENT DOCUMENTS 4,911,112 A * 3/1990 Oikawa et al. ..... 123/90.16
5,845,614 A 12/1998 Tanaka et al.
6,578,535 B1 * 6/2003 Spath et al. ..... 123/90.16

FOREIGN PATENT DOCUMENTS

| | | |
|---|---|---|
| DE | 197 17 537 | 12/1998 |
| DE | 102 10 747 | 10/2003 |
| EP | 0 323 234 | 7/1989 |

* cited by examiner

*Primary Examiner*—Thomas Denion
*Assistant Examiner*—Ching Chang
(74) *Attorney, Agent, or Firm*—Charles A. Muserlian

(57) ABSTRACT

The invention proposes a coupling mechanism (1) for relatively movable elements (2, 3) of a switchable cam follower (4) of a valve train of an internal combustion engine, a high lift being obtainable upon coupling of said elements (2, 3) and a lift smaller than the high lift being obtainable upon uncoupling of said elements (2, 3), a first one (2) of said elements comprising a guide bore (5) for at least one coupling piston (6) which, for achieving coupling, can be displaced partly beyond a parting surface (7) between said elements (2, 3) into an aligned reception (8) of a second one (3) of said elements, wherein upon cam lift and coupling of said elements (2, 3), a contact zone (9) between the piston (6) and the reception (8) is clearly spaced from an edge section (10) of the reception (8) on the parting surface (7). This can be implemented in practice, for instance, through a special "backwards" oriented flattened portion (14) on the piston (6). Material loading on the edge section (10) is thus avoided.

18 Claims, 1 Drawing Sheet

COUPLING MECHANISM

This application claims priority of German Application No. DE 103 60 098.1 filed on Dec. 20, 2003, and the benefit of U.S. Provisional Application No. 60/586,143 filed on Jul. 7, 2004.

FIELD OF THE INVENTION

The invention concerns a coupling mechanism for relatively movable elements, typically for a switchable cam follower, a switchable cam follower group or a switchable support device of a valve train of an internal combustion engine, a high lift being obtainable upon coupling of said elements and a lift smaller than the high lift being obtainable upon uncoupling of said elements, a first one of said elements comprising a guide bore for at least one coupling piston which, for achieving coupling, can be displaced partly beyond a parting surface between said elements into an aligned reception of a second one of said elements.

BACKGROUND OF THE INVENTION

A coupling mechanism of the pre-cited type considered as generic is disclosed in US 2002/0046718 A1. The play of the piston required in the reception of the outer element for achieving coupling, causes the piston to tilt in the reception. This always occurs during cam lift because an undersurface of the piston abuts against a corresponding counter surface of the reception of the outer element. Due to the tilting of the piston, a contact zone is displaced from the interior of the reception to an edge section of this toward the parting surface between the elements. If the reception into which the piston engages is a bore, only a point contact is made. In the case of a flattened piston that is displaced, for example, into a reception in the form of an annular groove in the outer element, a two-point contact is determinable.

The aforesaid point contact in the edge section leads to an extreme augmentation of the contact forces. If, additionally, undesired large deviations of form, rectangularity and parallelism exist, the aforesaid effect is aggravated. Due to the extremely high loads acting precisely on the edge section, the play in the coupling region increases in an unfavorable manner over the operating lifetime of the cam follower. This leads to a deformation of the edge section which, in the worst case, can result in binding between the two elements.

OBJECTS OF THE INVENTION

It is an object of the invention to provide a cam follower of the pre-cited type in which the aforesaid drawbacks are eliminated.

This and other objects and advantages of the invention will become obvious from the following detailed description.

SUMMARY OF THE INVENTION

The invention achieves the above objects by the fact that, upon cam lift and coupling of the elements, a contact zone between the piston and the reception is clearly spaced from an edge section of the reception on the parting surface, so that the contact zone is shifted inward into the reception. Contact between the piston and the reception is established preferably in an edge region of the piston at an outer end face of the piston.

The drawbacks described above are effectively avoided with the aforesaid measures. During the unavoidable tilting of the piston in its reception in case of coupling, the contact zone of the invention is displaced structurally away from the endangered edge section.

Although the invention is directed particularly to coupling mechanisms in cam followers, cam follower groups and switchable support devices for cam followers or cam follower groups, the scope of the invention is clearly much broader. In general, the inventive means can also be implemented in camshaft adjusting devices, for example in locking arrangements of such devices, in engine brake systems or even in pump drives.

A simple measure for shifting the contact zone into the interior of the reception upon coupling consists in modifying the piston itself. If, for instance, as disclosed in the cited prior art US 2002/0046718 A1, the piston has a stepped configuration and engages for achieving coupling into an annular groove of the outer element, the flattened portion of the piston serving as a coupling surface would be configured in the case of the present invention so as to taper toward an inner end face of the piston. In the region of the flattened portion, this piston, when viewed in longitudinal section, would thus have a quasi backward oriented conical or wedge-like shape.

Alternatively, the invention also proposes to configure the piston without a flattened portion but to make its taper as a circumferential, backward oriented cone or cone-like structure.

According to a further proposition of the invention, the outer periphery of the piston is entirely cylindric but the complementary reception in the outer element tapers in coupling direction at least in the coupling region.

If necessary, the contact zone can also be shifted inwards by providing a combined inclination on appropriate contact surfaces of the piston and the reception.

According to a further feature of the invention, the angle of taper $\alpha$ is situated in the range of $0° < \alpha \leqq 5°$, a particularly preferred range lying between 5' and 5°. If necessary, even this specified value of 5° may be slightly or strongly exceeded.

All in all, the invention offers a great number of possible geometric combinations between the piston and the reception.

According to a further proposition of the invention, a stop for the coupling element is arranged in the reception. This stop determines an end position of the piston in case of coupling, and, if the reception is made in the form of a through-hole, the piston cannot extend unintentionally out of this reception of the outer element.

The invention will now be described more closely with reference to the appended drawing.

DETAILED DESCRIPTION OF THE DRAWING

Figure 1:
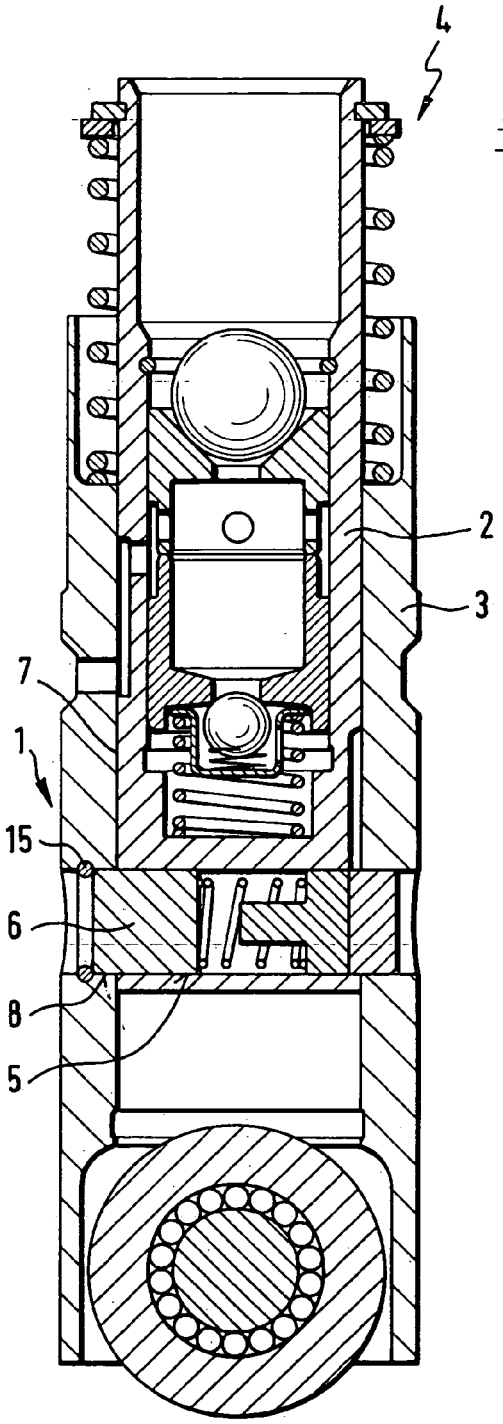
FIG. 1 shows a switchable cam follower in a longitudinal section.

FIG. 1 shows a longitudinal section through a switchable cam follower 4. This is configured in the present case as a roller tappet and comprises an outer element 3 that is inter-inserted with an inner element 2. The outer element 3 comprises a contact surface for a cam on one end, while the inner element 2 acts at an opposite end on a tappet push rod in lift direction of the cam.

Further, a coupling mechanism 1 of a type known, per se, is integrated in the cam follower 4. This coupling mechanism 1 comprises a guide bore 5 that extends radially through the inner element 2, and a reception 8 in the outer element 3, which reception is aligned to the guide bore 5 in case of coupling. Further, a coupling element in the form of a piston 6 extends in the guide bore 5. For achieving coupling, this piston 6 can be displaced radially outwards, by means needing no further specification, partly beyond a parting surface 7 between the elements 2, 3 into the reception 8. If desired, a stop element 15 may be arranged in the reception 8 for limiting the piston travel.

Figure 2:
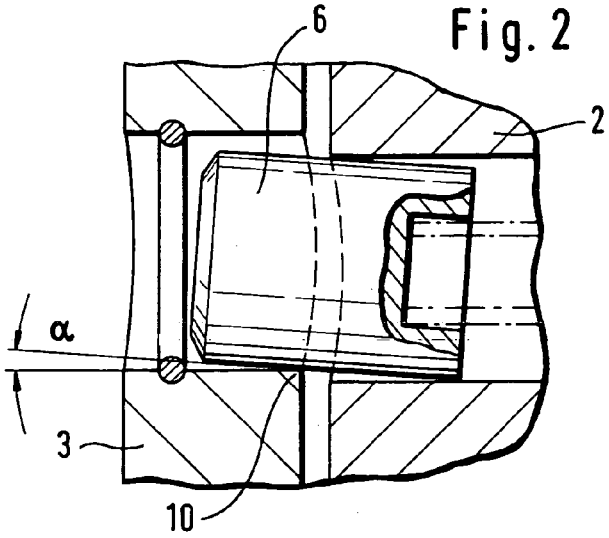
FIG. 2 illustrates a coupling mechanism comprising a cylindrical piston, in coupled state.
Figure 3:
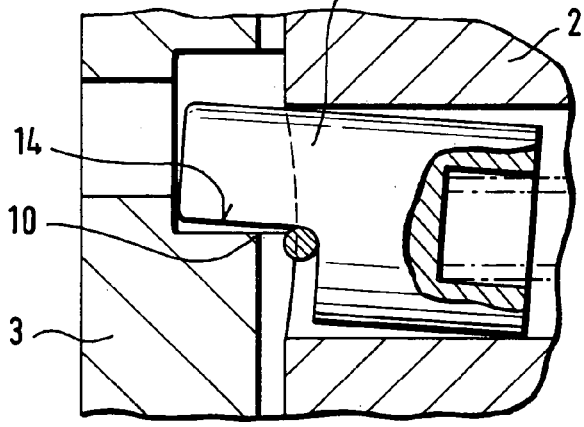
FIG. 3 illustrates a coupling mechanism comprising a flattened piston, in coupled state.

As discussed more clearly above and as best shown in FIGS. 2 and 3, the reception 8 has a play relative to the piston 6. Due to this play, the interlocking established upon coupling manifests a relatively low osculation factor. Therefore, the piston 6 compulsorily tilts in the reception 8 and in the guide bore 5 during cam lift. In the case of a completely cylindrical piston 6 as represented in FIG. 2, this results in a high-loading point contact of the piston 6 with the lower edge section 10 of the reception 8 at the parting surface 7. Due to the resulting wear, the play in the region of coupling increases. In undesired manner, the edge section 10 is gradually deformed and, given the conditions, a binding of the elements 2 and 3 can occur.

The same applies to the embodiment of FIG. 3 in which the piston 6 comprises a flattened portion 14 on the underside that in case of coupling extends onto a flat counter surface of a continuous annular groove constituting the reception 8 of the outer element 3. In case of tilting, a two-point contact with the reception 8 is to be expected.

Figure 4:
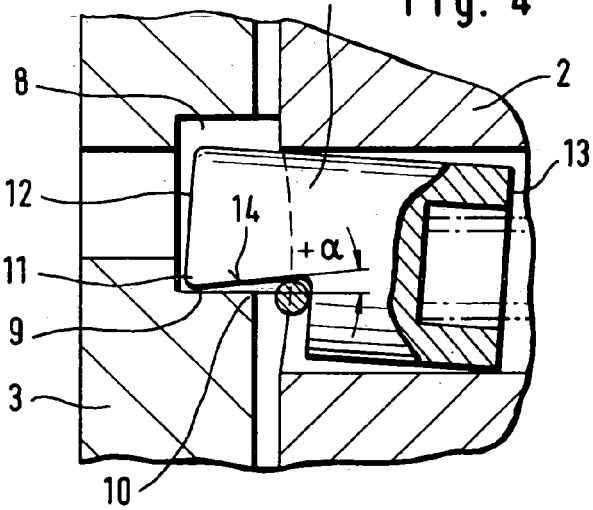
FIG. 4 shows the piston of FIG. 3 comprising the features of the invention.

FIG. 4 shows an advantageous embodiment of the invention in which a contact zone 9 between the piston 6 and its counter surface in the reception 8 is shifted inwards (as viewed in coupling direction) away from the edge section 10. Accordingly, this contact zone 9 is situated inside the reception 8 and, when coupling is completed, it lies directly in the edge region 11 of the piston 6 at its outer end face 12. On the side of the contact zone 9, the piston 6 comprises a flattened portion 14 which is situated opposite a flattened counter surface of the reception 8 that is configured in the form of an annular groove. With reference to a perpendicular line of the piston 6 to the parting surface 7, the flattened portion 14 is inclined in a quasi backward direction. The angle $\alpha$ of this inclination is situated in the range of $0°<\alpha\leqq 5°$, and may preferably start from 5'.

It goes without saying that this backward oriented inclination may also be circumferentially configured so that a backward oriented cone is generated that then extends, for example, into a complementary reception 8. As disclosed in FIG. 4, in case of coupling, the flattened portion 14 results in the formation of a line contact in the contact zone 9 in contrast to the disadvantageous two-point contact of the prior art.

The invention claimed is:

1. A coupling mechanism for relatively movable elements, for a switchable cam follower, a switchable cam follower group or a switchable support device of a valve train of an internal combustion engine, a high lift obtainable upon coupling of said elements and a lift smaller than the high lift being obtainable upon uncoupling of said elements, a first one of said elements comprising a guide bore for at least one coupling piston which, for achieving coupling, can be displaced partly beyond a parting surface between said elements into an aligned reception of a second one of said elements, wherein, upon cam lift and coupling of the elements, a contact zone between the piston and the reception is clearly spaced from an edge section of the reception on the parting surface, starting from the contact zone, the piston tapers relative to a perpendicular line of the parting surface at least in this peripheral section or on this side toward an inner end face.

2. A coupling mechanism of claim 1, for relatively movable elements, for a switchable cam follower, a switchable cam follower group or a switchable support device of a valve train of an internal combustion engine, a high lift obtainable upon coupling of said elements and a lift smaller than the high lift being obtainable upon uncoupling of said elements, a first one of said elements comprising a guide bore for at least one coupling piston which, for achieving coupling, can be displaced partly beyond a parting surface between said elements into an aligned reception of a second one of said elements, wherein, upon cam lift and coupling of the elements, a contact zone between the piston and the reception is clearly spaced from an edge section of the reception on the parting surface, starting from the contact zone, the piston tapers relative to a perpendicular line of the parting surface at least in this peripheral section or on this side toward an inner end face and wherein the contact zone of the piston is determined by an axially outer edge region of the piston on an outer end face of the piston as viewed in coupling direction.

3. A coupling mechanism of claim 2, wherein starting from the edge section on the parting surface, the reception tapers relative to a perpendicular line of the parting surface at least in this peripheral section or on this side at least up to the contact zone.

4. A coupling mechanism of claim 3, wherein an angle $\alpha$ of taper relative to the perpendicular line of the parting surface is situated in a range of $0°<\alpha\leqq 5°$.

5. A coupling mechanism of claim 3, wherein an angle $\alpha$ of taper relative to the perpendicular line of the parting surface is situated in a range of $5'<\alpha\leqq 5°$.

6. A coupling mechanism of claim 3, wherein, at least in a region between the edge section and the contact zone, the reception is made as a bore.

7. A coupling mechanism of claim 3, wherein, at least a region between the edge section and the contact zone, the reception has a flat configuration.

8. A coupling mechanism of claim 2 wherein, starting from the contact zone, the piston tapers relative to a perpendicular line of the parting surface at least in this peripheral section or on this side toward an inner end face and wherein, starting from the edge section on the parting surface, the reception tapers relative to a perpendicular line of the parting surface at least in this peripheral section or on this side at least up to the contact zone.

9. A coupling mechanism of claim 8, wherein an angle $\alpha$ of taper relative to the perpendicular line of the parting surface is situated in a range of $0°<\alpha\leqq 5°$.

10. A coupling mechanism of claim 8, wherein an angle $\alpha$ of taper relative to the perpendicular line of the parting surface is situated in a range of $5'<\alpha\leqq 5°$.

11. A coupling mechanism of claim 1, wherein an angle $\alpha$ of taper relative to the perpendicular line of the parting surface is situated in a range of $0° < \alpha \leqq 5°$.

12. A coupling mechanism of claim 1, wherein an angle $\alpha$ of taper relative to the perpendicular line of the parting surface is situated in a range of $5' < \alpha \leqq 5°$.

13. A coupling mechanism of claim 1, wherein, at least in a region between the edge section and the contact zone, the reception is made as a bore.

14. A coupling mechanism of claim 1, wherein, at least a region between the edge section and the contact zone, the reception has a flat configuration.

15. A coupling mechanism of claim 1, wherein a taper of the piston is configured as a continuous cone or has a cone-like configuration.

16. A coupling mechanism of claim 1, wherein for relatively movable elements, for a switchable cam follower, a switchable cam follower group or a switchable support device of a valve train of an internal combustion engine, a high lift obtainable upon coupling of said elements and a lift smaller than the high lift being obtainable upon uncoupling of said elements, a first one of said elements comprising a guide bore for at least one coupling piston which, for achieving coupling, can be displaced partly beyond a parting surface between said elements into an aligned reception of a second one of said elements, wherein, upon cam lift and coupling of the elements, a contact zone between the piston and the reception is clearly spaced from an edge section of the reception on the parting surface, a taper is made as a flattened portion.

17. A coupling mechanism of claim 16, wherein a peripheral section of the piston outside of the flattened portion is cylindric.

18. A coupling mechanism of claim 1, wherein a stop element for the piston is arranged in the reception.

* * * * *